United States Patent [19]

Wentzel et al.

[11] Patent Number: 5,054,368

[45] Date of Patent: Oct. 8, 1991

[54] RECOIL BUFFER UNIT

[76] Inventors: Bruce J. Wentzel, 6/1 Robin Way, Kelvin, Sandton; Philip N. Spencer, 1099 Sparrow Avenue, Kyalami Gardens Midrand, both of Transvaal, South Africa

[21] Appl. No.: 487,141

[22] Filed: Mar. 2, 1990

[30] Foreign Application Priority Data

Mar. 2, 1989 [ZA] South Africa ..... 89/1604

[51] Int. Cl.[5] ..... F41A 3/78

[52] U.S. Cl. ..... 89/196; 89/198

[58] Field of Search ..... 89/163, 196, 198

[56] References Cited

U.S. PATENT DOCUMENTS 2,522,192 9/1950 Porter ..... 89/198
2,900,877 8/1959 McClenahan ..... 89/198
4,485,728 12/1984 Sarong ..... 89/163

FOREIGN PATENT DOCUMENTS 637124 4/1928 France ..... 89/163

*Primary Examiner*—Stephen C. Bentley

*Attorney, Agent, or Firm*—Burns, Doane, Swecker & Mathis

[57] ABSTRACT

The invention relates to a recoil buffer unit for a pistol, of the type having a slide movable on a base member which carries the barrel of the pistol. The slide includes a forward and having a lower bore located beneath the barrel for accommodation of a return spring guide rod. A return spring surrounds the guide rod, to return the slide to its original position. Abutment surfaces are provided on both the slide and the base member for striking one another to halt the rearward movement of the slide. The recoil buffer unit includes a movable member, and a buffer. The buffer has an abutment member at one end thereof which abuts a surface of the pistol, and an intermediate striking surface. A cylinder containing elastomeric material is provided at one end of the buffer and a plunger is slidably receivable within the cylinder for engaging the elastomeric material. The movable member strikes the striking surface towards the end of the rearward movement of the slide to cause the plunger to compress the elastomeric material in the cylinder, thereby damping rearward movement of the slides.

8 Claims, 1 Drawing Sheet

RECOIL BUFFER UNIT

BACKGROUND TO THE INVENTION

This invention relates to a recoil buffer unit for a pistol.

Most conventional semi-automatic pistols are provided with a reciprocating slide which is movable on a base member, the base member carrying the barrel of the pistol. The slide has a forward end through which the barrel of the pistol projects, from which there depends a portion having a bore for accommodating a recoil spring guide rod. The recoil spring guide rod guides a recoil spring which acts between the forward end of the slide and the base member, and returns the slide to its original non-firing position after recoil of the slide, during which the slide moves rearwardly relative to the base member and barrel.

The abutment surfaces provided on both the slide and the base member abruptly halt the rearward movement of the slide relative to the base member by striking against one another. The metal abutment surfaces strike one another each time the pistol is fired, causing metal fatigue and possible cracking of both the slide and the base member thereby shortening the lifespan of the pistol.

A typical pistol of the type described above is the Beretta 92F 9 mm pistol, also known as the M-9. In this pistol, the return spring guide rod is a sliding fit in the bore. The abutment surface on the slide is constituted by a rear face of the lower tubular portion through which the guide rod extends. The pounding that this rear face is subjected to each time it contacts the corresponding abutment surface on the base member can result in permanent damage of the tubular portion after extended use of the pistol.

SUMMARY OF THE INVENTION

According to the invention, there is provided a recoil buffer unit for a pistol, the pistol being of the type having a slide movable on a base member which carries the barrel of the pistol, the slide having a forward end having an upper bore through which the barrel of the pistol projects during rearward movement of the slide and a lower bore located beneath the barrel, for accommodation of a return spring guide rod; a return spring surrounding the guide rod and serving to return the slide to its original position after recoil of the slide, during which the slide moves rearwardly relative to the barrel, and abutment surfaces provided on both the slide and the base member for striking against one another to terminate the rearward movement of the slide, the recoil buffer unit comprising a movable member movable with the slide, and a buffer, the buffer having an abutment member at one end thereof which abuts a surface of the pistol, a striking surface which is struck by the movable member towards the end of the rearward movement of the slide, a cylinder containing elastomeric material, and a plunger slidably receivable within the cylinder for engaging the elastomeric material, one of the cylinder and the plunger being movable relative to the abutment member and the other being movable relative to the striking surface, the movable member in use impacting the striking surface towards the end of the rearward movement of the slide to cause the plunger to compress the elastomeric material in the cylinder, thereby damping rearward movement of the slide.

In a preferred form of the invention, the recoil buffer unit acts as a recoil spring guide rod, the movable member being provided with a formation for seating one end of the recoil spring and the abutment member being provided with a face for seating the opposite end of the recoil spring.

In a preferred form of the invention, the movable member is slidably receivable on a guide pin which forms a forward portion of the buffer.

Preferably, the guide pin is of a smaller diameter than the bore of the tubular portion, and the movable member has a front boss which fits into the lower bore for guiding the guide pin.

Conveniently, the elastomeric material is a rubber material, which may be in the form of a number of elastomeric rubber pellets. The rubber pellets are preferably in the form of discs stacked one above the other in the cylinder, the discs having waisted side walls when in the non-compressed state, allowing the disc walls to expand outwardly against the cylinder when the discs are compressed.

The discs may be formed from insertion rubber provided with reinforcing matting.

The invention extends to a pistol, the pistol being of the type having a slide movable on a base member which carries the barrel of the pistol, the slide including a forward end having an upper bore through which the barrel of the pistol projects during rearward movement of the slide, and a lower bore located beneath the barrel, for accommodation of a return spring guide rod; a recoil spring surrounding the guide rod and serving to return the slide to its original position after recoil of the slide, during which the slide moves rearwardly relative to the barrel; and abutment surfaces provided on both the slide and the base member which strike against one another to halt the rearward movement of the slide, the pistol further including a recoil buffer unit, the recoil buffer unit comprising a movable member movable with the slide, and a buffer, the buffer having an abutment member at one end thereof which abuts a surface of the pistol, a striking surface which is struck by the movable member towards the end of the rearward movement of the slide, a cylinder containing elastomeric material, and a plunger slidably receivable within the cylinder for engaging the elastomeric material, one of the cylinder and the plunger being movable relative to the abutment member and the other being movable relative to the striking surface, the movable member in use impacting the striking surface towards the end of the rearward movement of the slide to cause the plunger to compress the elastomeric material in the cylinder, thereby damping rearward movement of the slide.

DESCRIPTION OF EMBODIMENTS

Figure 1:
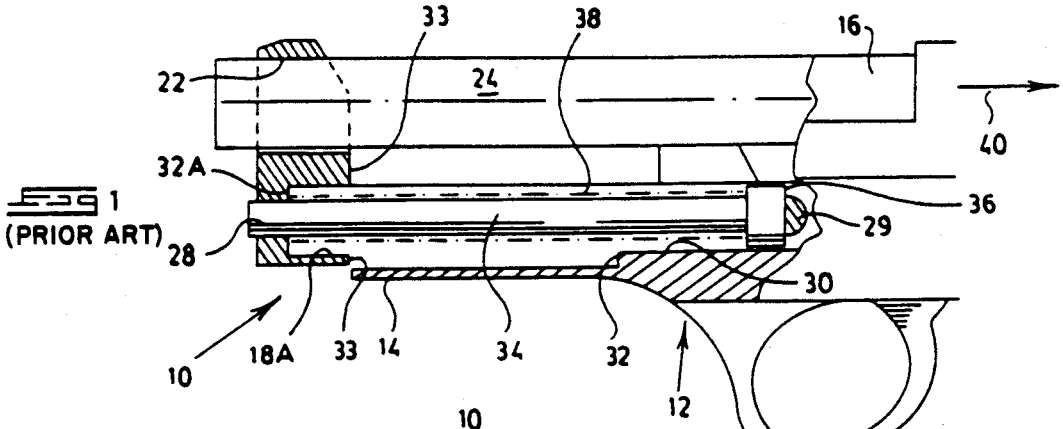
FIG 1 (PRIOR ART)
FIG. 1 shows a partly cross-sectional side view of a front end of a conventional pistol.

The pistol 10 partly illustrated in FIG. 1 represents a Beretta Model 92F 9 mm pistol. The pistol 10 comprises a base member 12 which has U-shaped cradle 14 at its forward end. A reciprocating slide 16 is mounted slidably on slides 18 provided on the upper end of the base member 12. The slide 16 terminates in a forward end portion 20 provided with a main bore 22 through which the barrel 24 of the pistol passes and a lower dependent portion 26 through which a subsidiary guide bore 28 passes, the central axes of the main bore 22 and the guide bore 28 being parallel. The lower portion 26 has a U-shaped profile which allows it slide complementally within the U-shaped cradle 14. An assembly latch 29 holds the barrel 24 in position on the base member 12.

Extending rearwardly from the rear end of the cradle 14 is a short key-hole shaped passage 30 bored into the material of the base member 12. As can be seen more clearly in FIG. 4, a horse-shoe shaped abutment surface 32 is provided at the beginning of the passage 30 and lies in a plane normal to the axis of the passage and extending upwardly towards the slides 18. A seat 32A is defined within the guide bore 28, at the commencement of a broadened extension 18A of the guide bore 28. An abutment surface 33 forms the rear face of the forward end portion 20 surrounding the guide bore extension 28A. A return spring guide rod 34 extends from the back face 36 of the passage 30 and forms a sliding fit through the bore 28. A return spring 38 surrounds the guide rod 34 and acts between the seat 32A and the back face 36.

When the pistol 10 is fired, the slide 16 recoils in the direction of arrow 40, and the return spring 38 is compressed. The rearward movement of the slide 10 is abruptly halted when the abutment surfaces 33 and 32 strike against one another.

As thus far described, the pistol 10 is entirely conventional; those components of the pistol which are not illustrated are well-known by those skilled in the art and do not assist in the understanding of the present invention.

Figure 5:
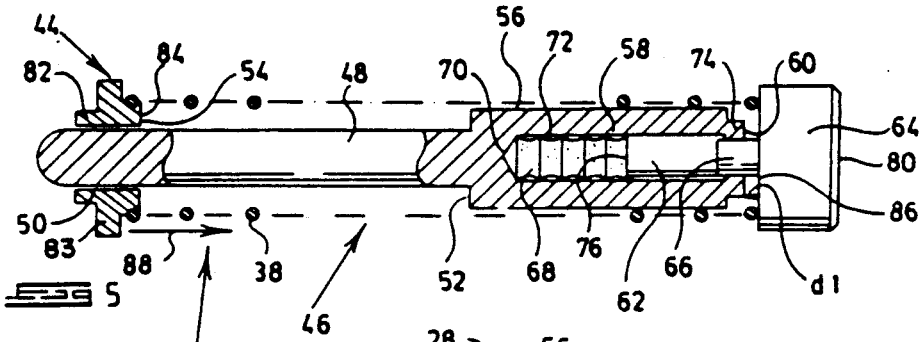
FIG. 5 shows a partly cross-sectional side view of the recoil buffer unit of the invention in the relaxed position.

Referring now to FIG. 5, a recoil buffer unit 42 of the invention has as its main components a movable member such a bush 44, and a buffer 46. The buffer 46 is provided towards its front end with a guide pin 48. A bore 50 is formed through the bush 44, having a diameter slightly greater than the guide pin 48 so as to allow the bush 44 to form a sliding fit with a guide pin 48. A striking surface 52 in the form of an annular shoulder is provided at the base of the guide pin 48, and the bush 44 has a rear face 54 adapted to strike the striking surface 52 during the recoil of the slide 16.

The buffer 42 is provided with a cylindrical portion 56 towards its rear end. An axial cylinder 58 is formed in the cylindrical portion 56, extending inwardly from the end 60 of the cylindrical portion. A plunger 62 forms a sliding fit within the cylinder 58, and is joined to an abutment member 64, which forms the head of the plunger 62, by an intermediate waist 66. A stack of five rubber discs 68 are sandwiched within the cylinder 58 between the plunger 62 and the base 70 of the cylinder. The discs are stamped from a sheet of insertion rubber having upper and lower surfaces impregnated with woven fiber. As a result, the discs have waisted walls 72 when in the non-compressed state. The cylindrical portion 56 has a cylindrical sleeve 74 at its rear end which is crimped inwardly so as to hold the plunger 62 captive within the cylinder 58, the free end 76 of the plunger bearing against the stack of rubber discs 68.

Figure 2:
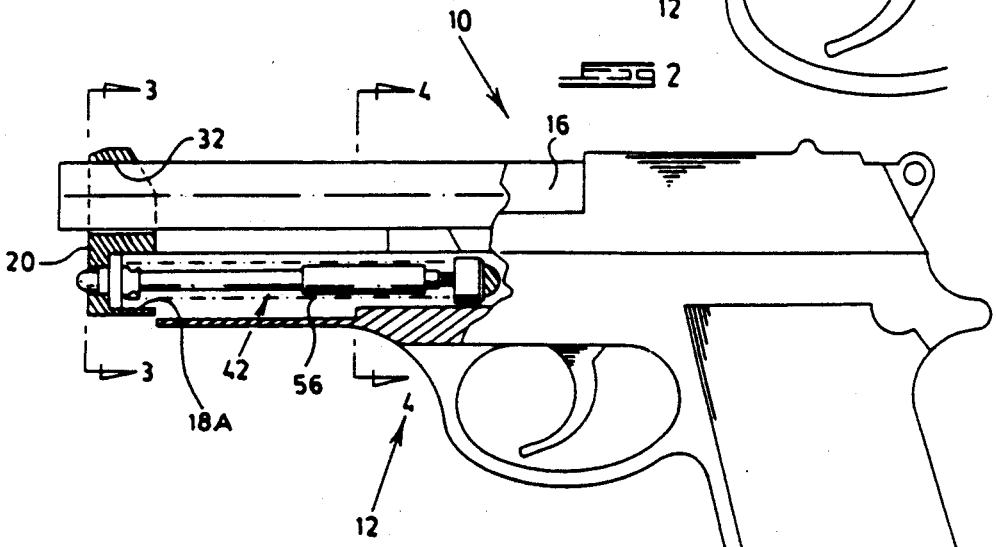
FIG. 2 shows a partly cross-sectional side view of the pistol of FIG. 1 modified with a recoil buffer unit of the invention.
Figure 3:
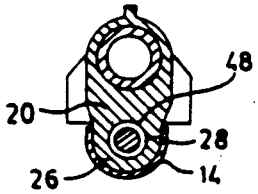
FIG. 3 shows a section on the line 3—3 of FIG. 2.
Figure 4:
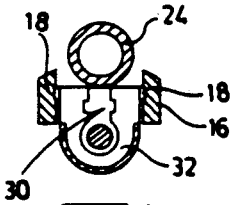
FIG. 4 shows a section on the line 4—4 of FIG. 2.

The pistol 10 of FIG. 1 is modified by removing the return spring 38 and the return spring guide rod 34, and replacing the return spring guide rod 34 with the recoil buffer unit 42, as is shown in FIGS. 2,3 and 4. The rear face 80 of the abutment member 64 is located against the back face 36 of the passage. The bush 44 has a front boss 82 which forms a snug fit within the bore 28, and an intermediate rib 83, which seats firmly within the bore extension 18A against the seat 32A. One end of the recoil spring 38 is clipped into a groove 84 formed in the bush 44 and the opposite end of the spring abuts the front face 86 of the plunger head 64.

Figure 6:
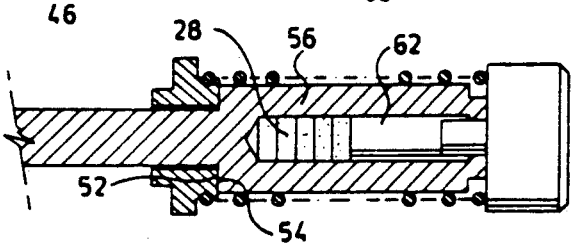
FIG. 6 shows a partly cross-sectional side view of the recoil buffer unit of FIG. 5 in the compressed position.

In operation, after the modified pistol of FIG. 2 has been fired, the slide 16 recoils, carrying with it the bush 44. The recoil continues in the direction of arrow 88 until the abutment face 54 on the bush 44 collides with the shoulder 52. Further movement of the slide 16 forces the cylindrical portion 56 rearwardly, causing the plunger 62 to compress the stack of rubber discs 68, as is shown in FIG. 6, thereby effectively damping the rearward movement of the slide 16. The rearward movement of the slide 16 is terminated once the end 60 of the cylindrical portion contacts the front face 86 of the abutment member. The compressibility of the stack of rubber discs 68 is calculated so that they compress fully over a distance of approximately 2.5 mm, which is the same as the distance d1 between the end 60 of the cylindrical portion and the front face 86 of the abutment member when the recoil buffer unit 42 is relaxed. Consequently, the end 60 of the cylindrical portion has slowed down to negligible velocity by the time it reaches the rear surface 86 of the abutment member 64, thereby substantially reducing any impact shock on the abutment member 64.

The recoil buffer unit of the invention serves to protect both the slide 16 and the base member 12 of the pistol against damage caused by metal-on-metal impact of abutment surfaces. As a result, the lifespan of a conventional pistol may be increased using such a recoil unit.

As the recoil buffer unit acts over a very short distance (2.5 mm), it does not adversely affect the operation of the return spring 38 or the return movement characteristics of the slide 16.

The recoil buffer unit can be expected to have a substantial lifespan; however on the basis of present experience, this can be expected to be less than that of the pistol. Should the recoil unit of the buffer of the invention fail, which could occur if the cylinder 58 becomes filled with oil or of the stack of rubber discs 68 lose their cushioning ability through fatigue, the operation of the pistol will not be adversely affected in the sense that the pistol will merely operate as if it had not been fitted with a recoil buffer unit in the first place. The recoil buffer unit can merely be replaced once it loses its effectiveness.

We claim:

1. A recoil buffer unit for a pistol, the pistol being of the type having a slide movable on a base member which carries the barrel of the pistol, the slide including a forward end having an upper bore through which the barrel of the pistol projects during rearward movement of the slide, and a lower bore located beneath the barrel for accommodation of a return spring guide rod; a return spring surrounding the guide rod and serving to return the slide to its original position after recoil of the slide, during which the slide moves rearwardly relative to the barrel; and abutment surfaces provided on both the slide and the base member for striking against one another to halt the rearward movement of the slide, the recoil buffer unit comprising a movable member movable with the slide, and a buffer, the buffer having an abutment member at one end thereof which abuts a surface of the pistol, a guide pin extending towards the opposite end thereof on which the movable member is slidably receivable, a striking surface at the base of the guide pin which is struck by the movable member towards the end of the rearward movement of the slide, a cylinder containing elastomeric material, and a plunger slidably receivable within the cylinder for engaging the elastomeric material, one of the cylinder and the plunger being movable relative to the abutment member and the other being movable relative to the striking surface; the movable member in use impacting the striking surface towards the end of the rearward movement of the slide to cause the plunger to compress the elastomeric material in the cylinder, thereby damping rearward movement of the slide.

2. A recoil buffer unit as claimed in claim 1 in which the recoil buffer unit acts as a recoil spring guide rod, the movable member being provided with a formation for seating one end of the recoil spring and the abutment member being provided with a face for seating the opposite end of the recoil spring.

3. A recoil buffer unit as claimed in claim 1 in which the guide pin is of a smaller diameter than the lower bore and the movable member has a front boss which lodges into the lower bore.

4. A recoil buffer unit as claimed in claim 1 in which the movable member is in the form of a bush.

5. A recoil buffer unit as claimed in claim 1 in which the elastomeric material is a rubber material.

6. A recoil buffer unit as claimed in claim 5 in which the rubber material is in the form of a plurality of elastomeric rubber pellets.

7. A recoil buffer unit as claimed in claim 6 in which the rubber pellets are in the form of discs stacked one above the other in the cylinder, the discs having waisted side walls when in the non-compressed state, allowing the disc walls to expand outwardly against the cylinder walls when the discs are compressed.

8. A recoil buffer unit as claimed in claim 7 in which the rubber discs are formed from insertion rubber provided with reinforcing matting.

* * * * *